US007629549B2

(12) United States Patent
Huang et al.

(10) Patent No.: US 7,629,549 B2
(45) Date of Patent: Dec. 8, 2009

(54) ROTARY SWITCH

(75) Inventors: Chen-Hong Huang, Taoyuan (TW); Chien-Hung Chen, Taoyuan (TW); Chia-Yi Cheng, Taoyuan (TW)

(73) Assignee: Solteam Electronics Co., Ltd, Taoyuan County (TW)

( * ) Notice: Subject to any disclaimer, the term of this patent is extended or adjusted under 35 U.S.C. 154(b) by 261 days.

(21) Appl. No.: 11/980,824

(22) Filed: Oct. 31, 2007

(65) Prior Publication Data

US 2009/0223796 A1 Sep. 10, 2009

(30) Foreign Application Priority Data

Aug. 13, 2007 (CN) ..... 2007 2 0127182 U

(51) Int. Cl.
*H01H 19/00* (2006.01)

(52) U.S. Cl. ..... 200/564; 200/568; 200/6 BB; 200/11 R

(58) Field of Classification Search ..... 200/11 R–11 K, 200/564–569, 336, 6 R–6 C; 341/35; 345/184
See application file for complete search history.

(56) References Cited

U.S. PATENT DOCUMENTS 3,497,643 A * 2/1970 Willans ..... 200/6 A
3,912,886 A * 10/1975 Allen et al. ..... 200/11 A
4,272,658 A * 6/1981 Crosby ..... 200/6 B
5,589,671 A * 12/1996 Hackbarth et al. ..... 200/6 R
5,594,220 A * 1/1997 Hackbarth et al. ..... 200/6 B
6,825,449 B2 * 11/2004 Kirby ..... 219/507
7,030,325 B2 * 4/2006 Blossfeld et al. ..... 200/11 R

* cited by examiner

*Primary Examiner*—Michael A Friedhofer
(74) *Attorney, Agent, or Firm*—Guice Patents PLLC

(57) ABSTRACT

A rotary switch includes a holder base holding two metal contact plates and one metal connection plate, a rotary handle vertically pivotally coupled to a pivot shaft of the holder base and rotatable relative to the holder base between a first position where a bottom recess of a circular actuating member of the rotary handle receives a respective electric connection portion of each metal contact plate and the electric connection portion of the metal connection plate contacts the electric connection portions of the metal contact plates and a second position where a protrusion of the circular actuating member forces the electric connection portion of one metal contact plate away from the metal connection plate to produce an electrical signal, and a torsion spring sleeved on the rotary handle with its two ends respective connected to the actuating member and the holder base for returning the rotary handle automatically after each rotary motion.

7 Claims, 6 Drawing Sheets

ROTARY SWITCH

BACKGROUND OF THE INVENTION

1. Field of the Invention

The present invention relates a rotary switch and more particularly to the use of a spring member in a rotary switch, which is durable in use and greatly prolongs the service life of the rotary switch.

2. Description of the Related Art

A switch is a requisite device for controlling the supply of power supply. By means of a power switch, the user can cut off power supply when its supply is not necessary, preventing a disaster. A power supply control switch can be a normal-close switch that is switched to an open-circuit status to switch off power supply when the supply of power supply is not necessary. Alternatively, a power supply control switch can be a normal-open switch that is switched to a close-circuit status to switch off power supply when the supply of power supply is not necessary. Therefore, any product that consumes power supply uses a power switch. A power switch obtains power supply by means of electrically connecting two electrodes to close the power circuit. When the two electrodes are disconnected, the power circuit is off. In some conditions, a switch can be used for the control of an electrical signal, for example, for cutting off power supply to produce a triggering signal that drives a control circuit to start an electric device.

FIG. 1 is an exploded view of a conventional rotary switch. According to this design, the rotary switch is comprised of a holder base 10, a springy frame 20, a rotary handle 30, and a top cover 40. The holder base 10 holds two metal contact plates 12 in a parallel manner on the inside space at one side. The metal contact plates 12 each have a vertical mounting legs 121 downwardly suspending at one end and inserted through a respective through hole 11 to the outside of the holder base 10, and an electric connection portion 122 horizontally disposed at the other end, and a contact 123 raised from the top side of the electric connection portion 122. The metal connection plate 13 comprises a mounting leg 131 perpendicularly downwardly extending from its one end and inserted through a respective through hole (not shown) of the holder base 1 for mounting, two electric connection portions 132 horizontally disposed in parallel at its other end, and two contacts 133 respectively protruded from the bottom sides of the electric connection portions 132 for contacting the contacts 123 of the two metal contact plates 12 respectively.

The springy frame 20 is provided at the top side of the holder base 10. The rotary handle 30 is pivoted to a pivot shaft 14 of the holder base 10. The top end of the rotary handle 30 is inserted through an axle hole 41 of the top cover 40 that is covered on the holder base 10 to hold down the springy frame 20. The rotary handle 30 has a bottom actuating block 31 suspending inside the springy frame 20. The bottom actuating block 31 comprises two opposite flat peripheral walls, two arched peripheral walls between the flat peripheral walls, a bottom protrusion 32 and a bottom recess 33.

When the rotary switch is not operated as shown in FIGS. 2*a* and 2*b*, the two opposite flat peripheral walls and two arched peripheral walls of the bottom actuating block are kept spaced from the inside wall of the spring frame 20, at this time the bottom recess 33 receives a slotted triangular holding down portion 124 of the electric connection portion 122 of one metal contact plate 12, allowing the material spring power of the respective metal contact plate 12 to force the respective contact 123 into contact with the associating contact 133 of the metal connection plate 13, and therefore the rotary switch is in a normal-close status.

On the contrary, when the user rotates the rotary handle 30 on the pivot shaft 14 through an angle, as shown in FIGS. 3*a* and 3*b*, the arched peripheral walls of the bottom actuating block 31 forces the springy frame 20 to deform, and at the same time the bottom protrusion 32 of the actuating block 31 is pressed on the slotted triangular holding down portion 124 of the electric connection portion 122 of one metal contact plate 12 to force the respective contact 123 downwardly away from the associating contact 133 of the metal connection plate 13, producing an electrical signal to an electric home appliance, for example, the control circuit of a washing machine. Upon receipt of the electrical signal from the rotary switch, the control circuit is caused to start the motor of the washing machine. After production of the electrical signal, the springy frame 20 releases energy to return the rotary handle 30 to its former position.

According to the aforesaid design, the springy frame 20 is molded from plastics. It starts to wear after a long use, and will easily cause elastic fatigue due to the effect of weather and temperature. Therefore, an improvement in this regard is necessary.

SUMMARY OF THE INVENTION

The present invention has been accomplished under the circumstances in view. It is the main object of the present invention to provide a rotary switch, which uses a metal spring member to substitute for the prior art springy frame, eliminating the problem of elastic fatigue and prolonging the service life of the rotary switch.

According to one aspect of the present invention, the rotary switch comprises a holder base, a rotary handle, a spring member, and a top cover. The holder base is an electrically insulative top-open box holding two metal contact plates and a metal connection plate bilaterally on the inside. The holder base comprises a pivot shaft upwardly extending from the bottom wall and a rod protruded from the top side of the peripheral wall thereof. The metal contact plates and the metal connection plate each comprise a mounting leg respectively extending out of the holder base for mounting. The metal contact plates each comprise an electric connection portion disposed inside the holder base. The metal connection plate comprises two electric connection portions respectively disposed in contact with the electric connection portions of the metal contact plates. The rotary handle is axially pivotally coupled to the pivot shaft of the holder base, having a bottom end fixedly provided with a circular actuating member. The circular actuating member comprises a protrusion and a recess at the bottom side corresponding to the electric connection portion of one metal contact plate. The spring member is sleeved onto the rotary handle, having one end stopped against the actuating member and an opposite end fastened to the rod of the holder base. The top cover is covered on the holder base, having an axle hole for the passing of the rotary handle. When the user rotates the rotary handle on the pivot shaft through an angle, the spring member is compressed to preserve energy, and the protrusion of the actuating member is pressed on the electric connection portion of one metal contact plate to electrically disconnect the associating metal contact plate from the electric connection portion of the metal connection plate, thereby producing an electrical signal. When the user releases the hand from the rotary handle, the spring member releases preserved energy to return the rotary handle.

According to another aspect of the present invention, the actuating member comprises a side cut, and the holder base comprises a stop block for acting against the side cut of the actuating member to limit rotation of the rotary handle relative to the holder base to a limited range.

According to another aspect of the present invention, the spring member can be a torsional spring.

According to still another aspect of the present invention, the electric connection portions of the metal contact plates each comprise a slotted triangular holding down portion, and the actuating member is rotatable with the rotary handle relative to the holder base between a first position where the recess of the actuating member receives the electric contact portions of the metal contact plate and the electric connection portions of the metal contact plate are kept in contact with the electric connection portions of the metal connection plate, and a second position where the protrusion of the actuating member is pressed on the electric connection portion of one metal contact plate to electrically disconnect the associating metal contact plate from the metal connection plate.

According to still another aspect of the present invention, the electric connection portions of the metal contact plate each have a raised electric contact disposed at the top side, and the two electric connection portion of the metal connection plate each have a raised electric contact for contacting the raised electric contacts of the metal contact plates.

According to still another aspect of the present invention, the holder base comprises a side slot and a retaining notch at one end of the side slot, and the spring member is sleeved onto the rotary handle with its one end stopped at the retaining notch at one end of the side slot of the holder base and its opposite end extending through the side slot and fastened to the rod of the holder member.

According to still another aspect of the present invention, the holder base comprises two mounting grooves vertically disposed on the outside wall at two opposite sides, and the top cover comprises two mounting legs respectively fastened to the mounting grooves of the holder base.

DETAILED DESCRIPTION OF THE PREFERRED EMBODIMENT

Figure 1:
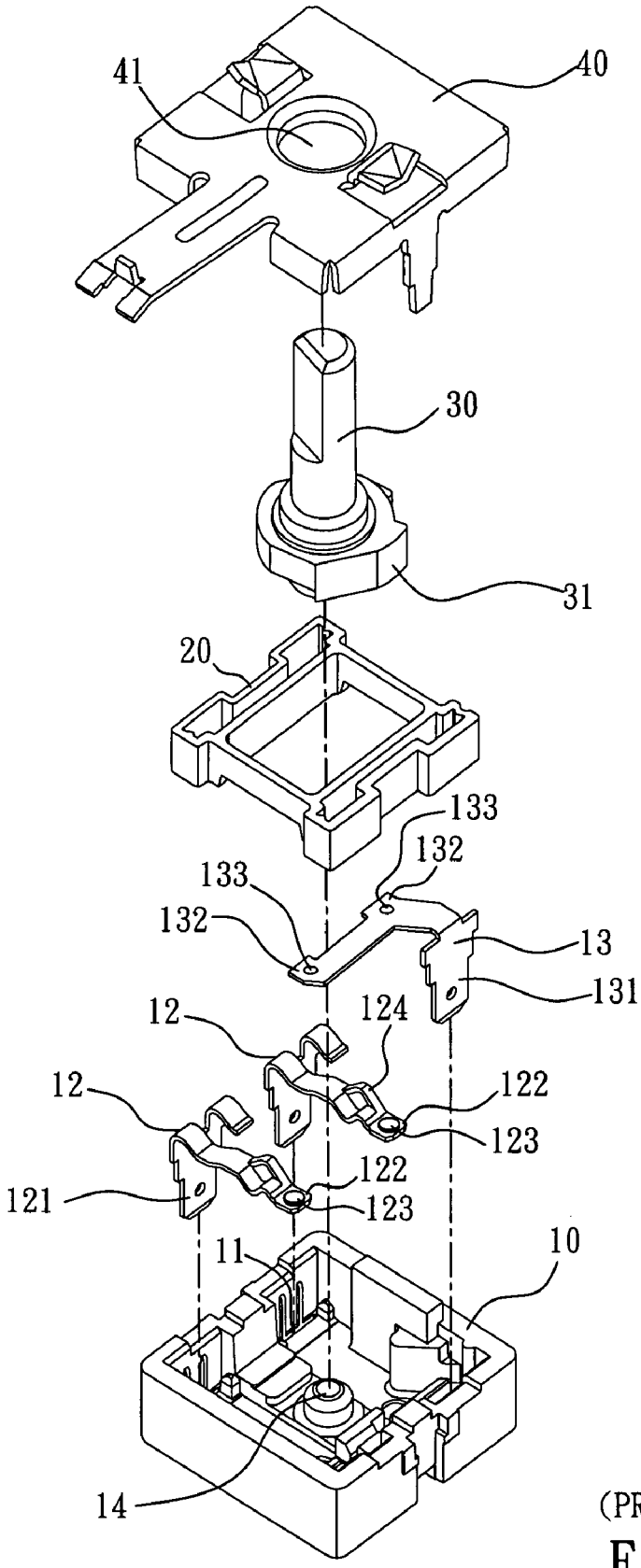
(PRIOR ART) FIG. 1
FIG. 1 is an exploded view of a rotary switch according to the prior art.
Figure 2A:
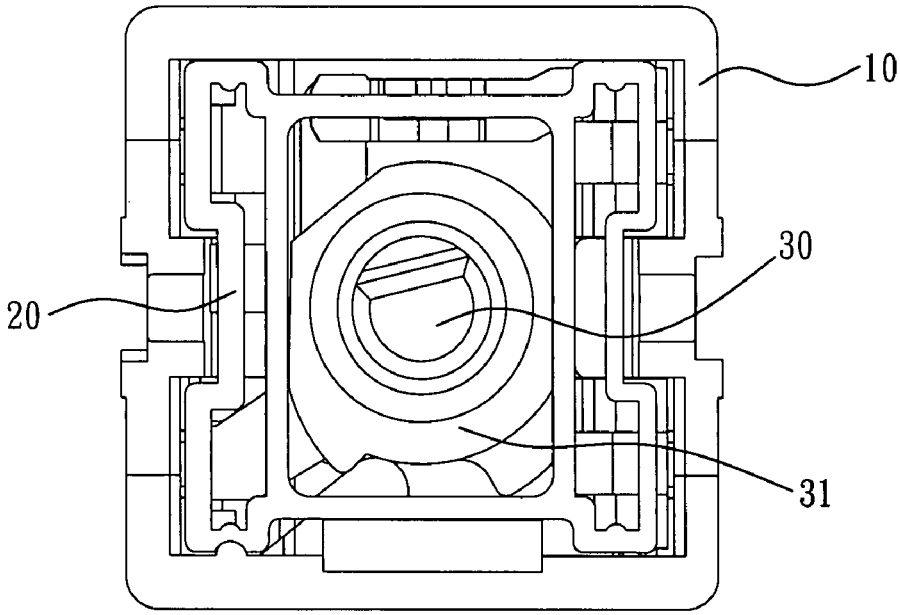
(PRIOR ART) FIG. 2a
FIG. 2*a* is a top view of the rotary switch according to the prior art before operation.
Figure 2B:
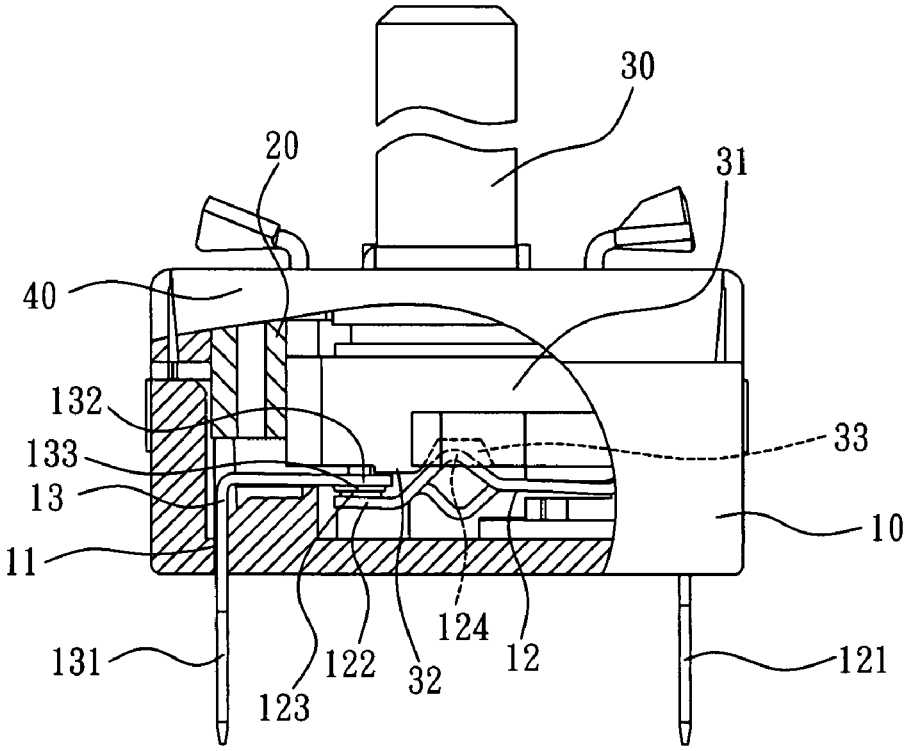
(PRIOR ART) FIG. 2b
FIG. 2*b* is a sectional view of the rotary switch according to the prior art before operation.
Figure 3A:
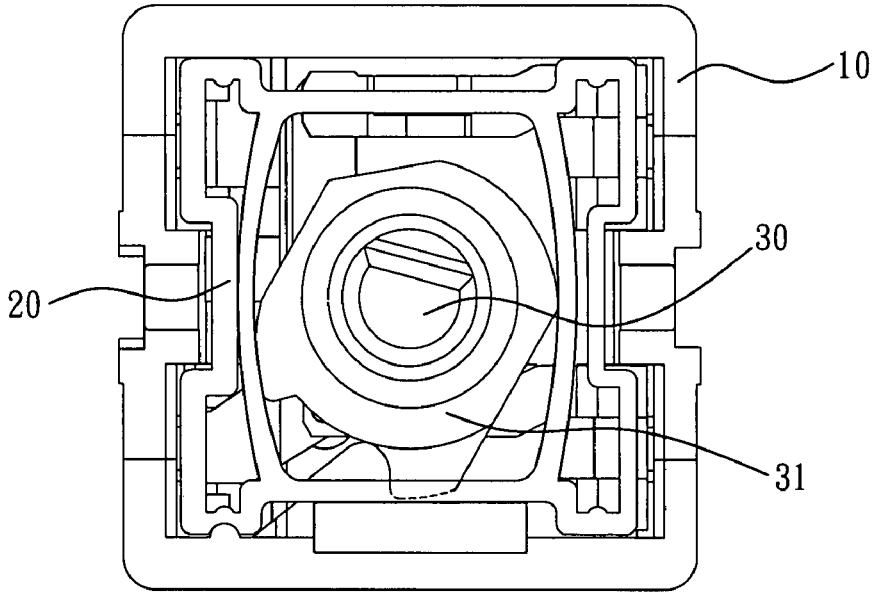
(PRIOR ART) FIG. 3a
FIG. 3*a* corresponds to FIG. 2*a*, showing the rotary switch operated.
Figure 3B:
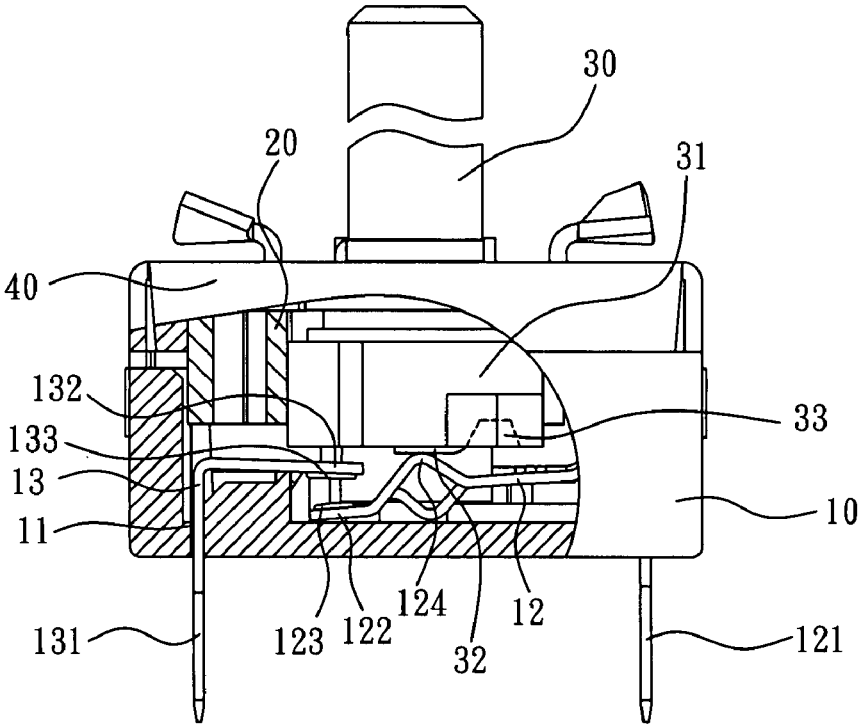
(PRIOR ART) FIG. 3b
FIG. 3*b* corresponds to FIG. 2*b*, showing the rotary switch operated.
Figure 4:
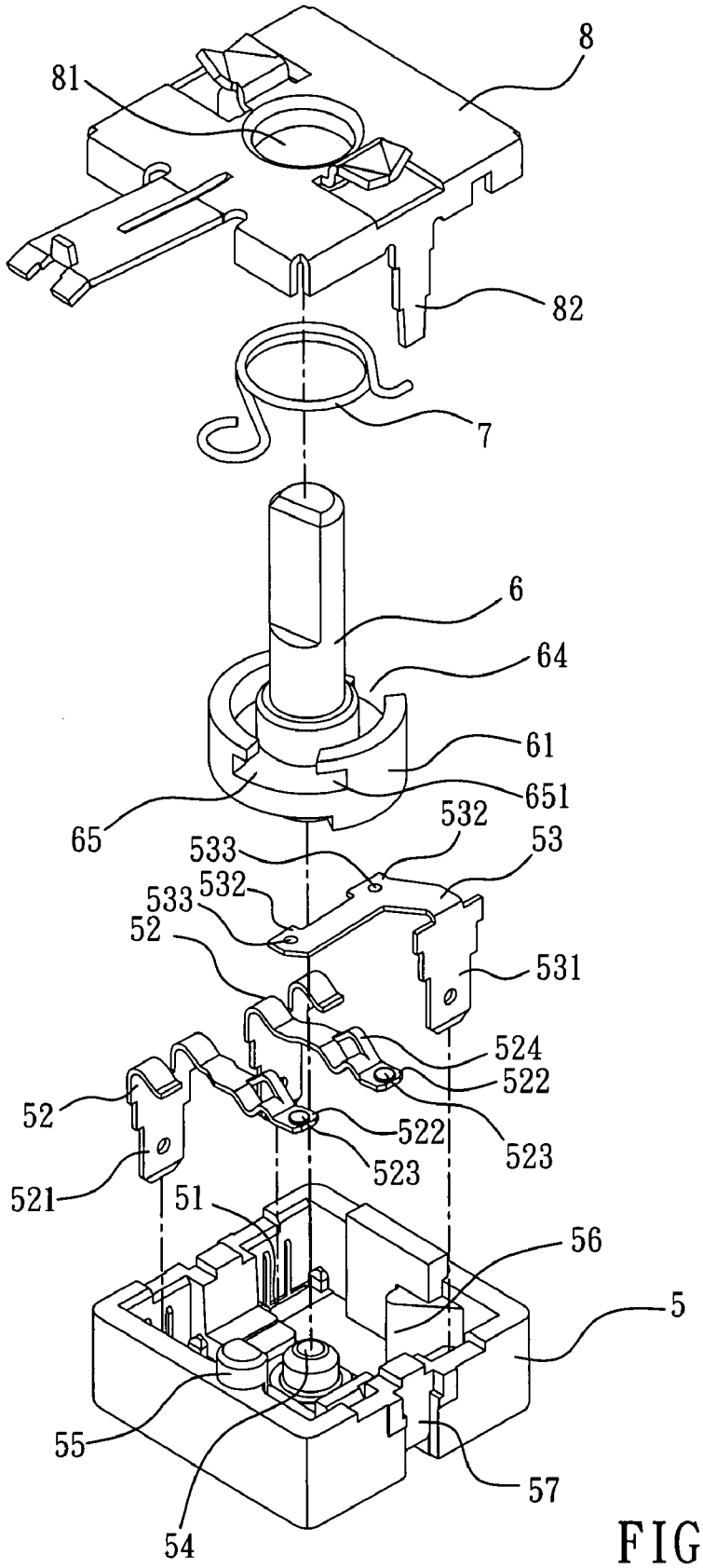
FIG. 4 is an exploded view of a rotary switch in accordance with the present invention.
Figure 5A:
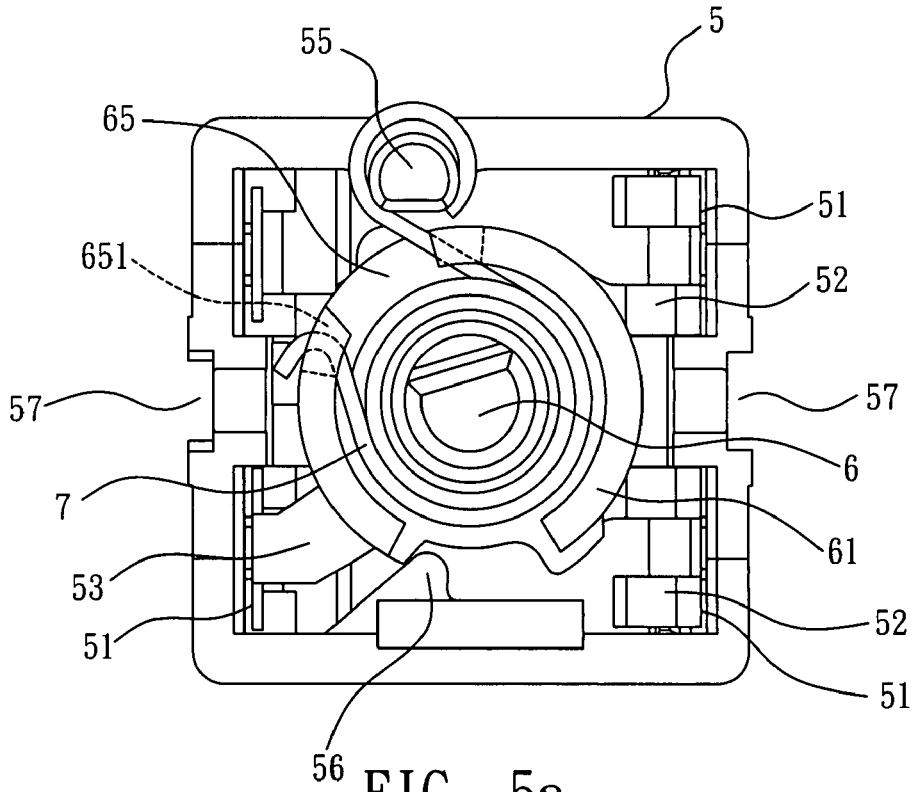
FIG. 5*a* is a top view of the present invention, showing the status of the rotary switch before operation.
Figure 5B:
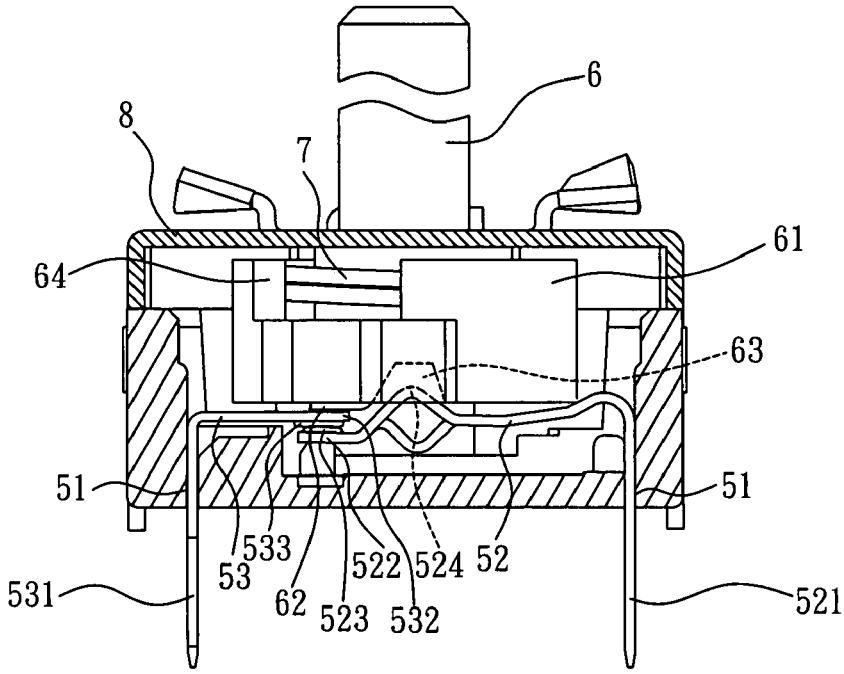
FIG. 5*b* is a sectional view of the present invention, showing the status of the rotary switch before operation.

Referring to FIGS. 4, 5*a* and 5*b*, a rotary switch in accordance with the present invention is shown comprised of a pair of holder base 5, a rotary handle 6, a spring member 7, and a top cover 8.

The holder base 5 is an electrically insulative top-open box holding two metal contact plates 52 and a metal connection plate 53 bilaterally on the inside. Each metal contact plate 52 comprises a mounting leg 521 perpendicularly downwardly extending from its one end and inserted through a respective through hole 51 at one side inside the holder base 5 for mounting, an electric connection portion 522 horizontally disposed at the other end, and a contact 523 raised from the top side of the electric connection portion 522. The metal connection plate 53 comprises a mounting leg 531 perpendicularly downwardly extending from its one end and inserted through a respective through hole (not shown) to the outside of the holder base 5 for mounting, two electric connection portions 532 horizontally disposed in parallel at its other end, and two contacts 533 respectively protruded from the bottom sides of the electric connection portions 532 for contacting the contacts 523 of the two metal contact plates 52 respectively (see the normal-close status shown in FIG. 5*b*).

The holder base 5 comprises an upright pivot shaft 54 disposed on the inside between the metal contact plates 52 and the metal connection plate 53, and a rod 55 upwardly protruded from the topmost edge at one side.

The rotary handle 6 is a rod member vertically upwardly inserted with its top end through the center axle hole 81 of the top cover 8, and coupled with its bottom end to the pivot shaft 54 of the holder base 5. The bottom end of the rotary handle 6 is fixedly provided with a circular actuating member 61. The circular actuating member 61 comprises a protrusion 62 (see FIG. 6*b*) and a recess 63 (see FIG. 5*b*) at its bottom side corresponding to the electric connection portion 522 of one metal contact plate 52, a side slot 65, two locating notches 651 at two ends of the side slot 65, and a side cut 64 disposed at one side remote from the side slot 65.

The spring member 7 according to this embodiment is a torsional spring sleeved onto the rotary handle 6, having one end stopped against one locating notch 651 of the actuating member 61 and the other end inserted through the side slot 65 and fastened to the rod 55 of the holder base 5. Therefore, when the rotary handle 6 is rotated through an angle, the spring member 7 is compressed. When the user released the hand from the rotary handle 6, the spring force of the spring member 7 immediately returns the rotary handle 6 to its former position.

Further, the holder base 5 comprises a stop block 56 for acting against the side cut 64 of the actuating member 61 of the rotary handle 6 to limit rotation of the rotary handle 6 relative to the holder base 5 to a limited range.

The top cover 8 is a flat cover plate, having the aforesaid center axle hole 81 and two bottom mounting legs 82 downwardly disposed at two sides. After the top cover 8 is covered on the holder base 5, the mounting legs 82 are respectively fastened to a respective vertically extending mounting groove 57 on the outside wall of the holder base 5 to fixedly secure the top cover 8 to the holder base 5.

When the rotary switch is not operated as shown in FIGS. 5*a* and 5*b*, the spring member 7 that is mounted on the rotary handle 6 has its one end stopped at the locating notch 651 at one end of the side slot 65 and its other end fastened to the rod 55 of the holder base 5, keeping in a balanced status. At this time, the recess 63 of the actuating member 61 receives a slotted triangular holding down portion 524 of the electric connection portion 522 of one metal contact plate 52, allowing the material spring power of the respective metal contact plate 52 to force the respective contact 523 into contact with the associating contact 533 of the metal connection plate 53, and therefore the rotary switch is in a normal-close status.

Figure 6A:
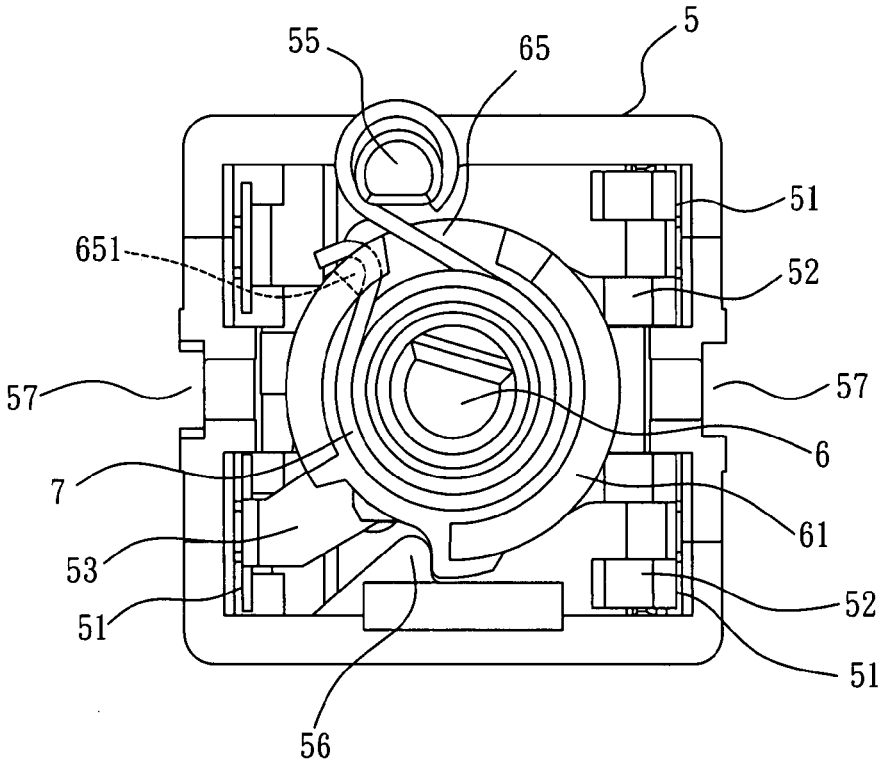
FIG. 6*a* corresponds to FIG. 5*a*, showing the rotary switch operated.
Figure 6B:
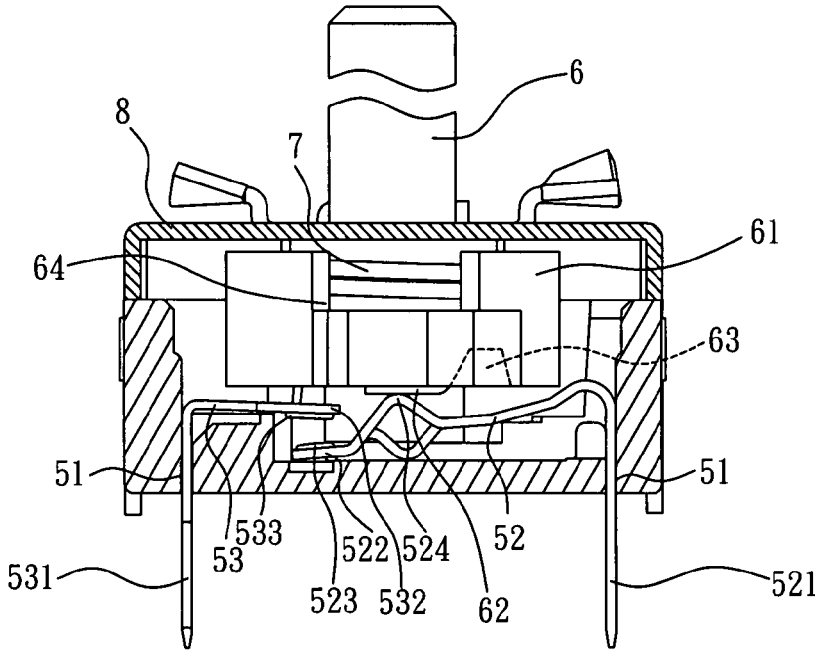
FIG. 6*b* corresponds to FIG. 5*b*, showing the rotary switch operated.

On the contrary, when the user rotates the rotary handle 6 on the pivot shaft 54 through an angle, as shown in FIGS. 6*a* and 6*b*, the spring member 7 is compressed to preserve energy, and the protrusion 62 of the actuating member 61 is pressed on the slotted triangular holding down portion 524 of the electric connection portion 522 of one metal contact plate 52 to force the respective contact 523 downwardly away from the associating contact 533 of the metal connection plate 53, producing an electrical signal to an electric home appliance, for example, the control circuit of a washing machine. Upon receipt of the electrical signal from the rotary switch, the control circuit is caused to start the motor of the washing machine. After production of the electrical signal, the spring member 7 releases energy to return the rotary handle 6 to its former position.

Further, the spring member of the rotary switch according to the present invention can be, for example, a torsional spring made of a weather-resistant and high-temperature-resistant metal material that is durable, prolonging the service life. When rotating the rotary handle, the spring member is compressed to preserve energy, and therefore the spring member releases preserved energy to return the rotary handle after the user released the hand from the rotary handle. In general, the invention eliminates the problem of the springy plastic frame used in the prior art design that easily cause elastic fatigue due to the effect of weather or high temperature.

Although a particular embodiment of the invention has been described in detail for purposes of illustration, various modifications and enhancements may be made without departing from the spirit and scope of the invention.

What is claimed is:

1. A rotary switch comprising:

a holder base, said holder base being an electrically insulative top-open box holding two metal contact plates and a metal connection plate bilaterally on the inside, said holder base comprising a pivot shaft upwardly extending from a bottom wall thereof and a rod protruded from a top side of a peripheral wall thereof, said metal contact plates and said metal connection plate each comprising a mounting leg respectively extending out of said holder base for mounting, said metal contact plates each comprising an electric connection portion disposed inside said holder base, said metal connection plate comprising two electric connection portions respectively disposed in contact with the electric connection portions of said metal contact plates;

a rotary handle axially pivotally coupled to said pivot shaft of said holder base, said rotary handle having a bottom end fixedly provided with a circular actuating member, said circular actuating member comprising a protrusion and a recess at a bottom side thereof corresponding to the electric connection portion of one of said metal contact plates;

a spring member sleeved onto said rotary handle, said spring member having one end stopped against said actuating member and an opposite end fastened to the rod of said holder base; and a top cover covered on said holder base, said top cover having an axle hole for the passing of said rotary handle;

wherein when the user rotates said rotary handle on said pivot shaft through an angle, said spring member is compressed to preserve energy, and the protrusion of said actuating member is pressed on the electric connection portion of one of said metal contact plates to electrically disconnect the associating metal contact plate from the electric connection portion of said metal connection plate, thereby producing an electrical signal; when the user releases the hand from said rotary handle, said spring member releases preserved energy to return said rotary handle.

2. The rotary switch as claimed in claim 1, wherein said actuating member comprises a side cut; said holder base comprises a stop block for acting against the side cut of said actuating member to limit rotation of said rotary handle relative to said holder base to a limited range.

3. The rotary switch as claimed in claim 1, wherein said spring member is a torsional spring.

4. The rotary switch as claimed in claim 1, wherein the electric connection portions of said metal contact plates each comprise a slotted triangular holding down portion; said actuating member is rotatable with said rotary handle relative to said holder base between a first position where the recess of said actuating member receives the electric contact portions of said metal contact plate and the electric connection portions of said metal contact plate are kept in contact with the electric connection portions of said metal connection plate and a second position where the protrusion of said actuating member is pressed on the electric connection portion of one of said metal contact plates to electrically disconnect the associating metal contact plate from said metal connection plate.

5. The rotary switch as claimed in claim 1, wherein the electric connection portions of said metal contact plate each have a raised electric contact disposed at a top side thereof; the two electric connection portion of said metal connection plate each have a raised electric contact for contacting the raised electric contacts of said metal contact plates.

6. The rotary switch as claimed in claim 1, wherein said holder base comprises a side slot and a retaining notch at one end of said side slot; said spring member is sleeved onto said rotary handle, having one end stopped at the retaining notch at one end of said side slot of said holder base and an opposite end extending through said side slot and fastened to said rod of said holder member.

7. The rotary switch as claimed in claim 1, wherein said holder base comprises two mounting grooves vertically disposed on an outside wall thereof at two opposite sides; said top cover comprises two mounting legs respectively fastened to the mounting grooves of said holder base.

* * * * *